US006684824B2

(12) United States Patent
Higa et al.

(10) Patent No.: US 6,684,824 B2
(45) Date of Patent: Feb. 3, 2004

(54) LIQUID FUEL REFORMER AND INTERNAL COMBUSTION ENGINE

(75) Inventors: Teruo Higa, Ginowan (JP); Takafuku Kato, Seto (JP)

(73) Assignee: Em Research Organization, Inc., Okinawa (JP)

( * ) Notice: Subject to any disclaimer, the term of this patent is extended or adjusted under 35 U.S.C. 154(b) by 191 days.

(21) Appl. No.: 09/966,041

(22) Filed: Sep. 28, 2001

(65) Prior Publication Data

US 2003/0072696 A1 Apr. 17, 2003

(30) Foreign Application Priority Data

Sep. 29, 2000 (JP) ..... 2000-300031
Sep. 14, 2001 (JP) ..... 2001-279287

(51) Int. Cl.[7] ..... F02M 27/00
(52) U.S. Cl. ..... 123/3
(58) Field of Search ..... 422/186.01, 222; 123/445, 538, 536, 537, 3, 1 A, DIG. 12; 210/222, 223, 695

(56) References Cited

U.S. PATENT DOCUMENTS 4,935,133 A * 6/1990 Hirama ..... 210/222
5,753,124 A * 5/1998 Bogatin et al. ..... 210/695
5,873,353 A * 2/1999 Makita ..... 123/538

FOREIGN PATENT DOCUMENTS

JP 08028373 A * 1/1996 ..... F02M/27/04
JP 09028535 A * 2/1997 ..... A47G/9/00

* cited by examiner

*Primary Examiner*—Henry C. Yuen
*Assistant Examiner*—Hyder Ali
(74) *Attorney, Agent, or Firm*—Pearson & Pearson, LLP

(57) ABSTRACT

Contained within an enclosure formed by an outer cylinder 2 and couplings 5, 5 equipped with connection ports 7, 7 connected to a liquid fuel system there are ceramic bodies 11, 11, which are formed by baking or firing of a substance wherein an effective microorganism colony, or a material obtained by fermentation thereof, or both, has or have been kneaded, and which are respectively arranged between the north poles N, N, . . . and the south poles S, S, . . . of permanent magnets 10, 10, . . . .

2 Claims, 4 Drawing Sheets

LIQUID FUEL REFORMER AND INTERNAL COMBUSTION ENGINE

BACKGROUND

The present invention pertains to a reformer capable of reforming liquid fuel so as to cause it to burn well, and to an internal combustion engine incorporating such a reformer.

Known reforming art pertaining to liquid fuels and having the object of improving combustion efficiency includes art involving addition of reformant and art involving application of heat or pressure. With respect to addition of reformant, this must be done at each instance of refueling. Furthermore, with respect to heating and the like, processing must be carried out using special-purpose equipment prior to supply of fuel.

All of the methods of the aforementioned reforming art necessitate that an operation be carried out at the time of liquid fuel refueling, this being troublesome and thus threatening the long-lived continuation of reforming and the benefits of conservation of resources and preservation of the environment which result from use of fuel improved by such reforming.

The object of the invention is therefore to provide a liquid fuel reformer and an internal combustion engine allowing reforming of liquid fuel to be carried out in convenient fashion while rendering fuel more or less completely combustible and permitting improved mileage as well as cleaner exhaust gases and flow passages.

SUMMARY

The present invention pertains to a reformer capable of reforming liquid fuel so as to cause it to burn well, and to an internal combustion engine incorporating such a reformer.

As recited in claim 1, one aspect of the invention is a liquid fuel reformer comprising a case into and out from which liquid fuel can flow; one or more ceramic bodies disposed within said case and formed by baking or firing of a substance wherein one or more items selected from among the group consisting of an effective microorganism colony and a derivative of an effective microorganism colony has or have been contained; and at least one pair of permanent magnets arranged such that there is a prescribed interval therebetween and such that opposite magnetic poles straddle the aforesaid ceramic body or bodies.

Furthermore, as recited in claim 2, another aspect of the invention is a liquid fuel reformer comprising a case into and out from which liquid fuel can flow; one or more permanent magnets arranged such that the north pole or poles thereof face in a prescribed direction; and at least two ceramic bodies formed by baking or firing of a substance wherein one or more items selected from among the group consisting of an effective microorganism colony and a derivative of an effective microorganism colony has or have been contained; the aforesaid permanent magnet or magnets being disposed within said case such that all or any subset of said magnet or magnets are or is straddled in some fashion by at least two of the aforesaid ceramic bodies. Here and below, to the extent that the ceramic bodies either individually or collectively possess directionality, the prescribed direction in which the north pole or poles face is a direction occupied by any one or more of those bodies and is preferably the upstream fuel direction.

Moreover, as recited in claim 3, another aspect of the invention is a liquid fuel reformer such as that recited in claim 1 or claim 2 wherein the aforesaid ceramic body or bodies and the aforesaid permanent magnet or magnets are formed from a plurality of substantially flat members, one or more holes being formed in each such member, and such members being stacked one atop another such that holes of adjacent members overlap in the thickness direction so as to form a channel or channels for passage of liquid at the interior thereof.

In addition, as recited in claim 4, another aspect of the invention is a liquid fuel reformer according to claim 1 or claim 2 wherein the aforesaid ceramic body or bodies comprises or comprise a plurality of members that are more or less spherical in shape.

Furthermore, as recited in claim 5, yet another aspect of the invention is an internal combustion engine wherein one or more ceramic bodies disposed so as to be straddled by opposite poles of a permanent magnet and formed by baking or firing of a substance wherein one or more items selected from among the group consisting of an effective microorganism colony and a derivative of an effective microorganism colony has or have been contained is or are arranged so as to permit contact with liquid fuel passing therethrough at an appropriate location in a fuel supply path.

Moreover, as recited in claim 6, yet another aspect of the invention is an internal combustion engine wherein one or more permanent magnets arranged such that the north pole or poles thereof face in a prescribed direction and such that all or any subset of said magnet or magnets are or is straddled in some fashion by at least two ceramic bodies formed by baking or firing of a substance wherein one or more items selected from among the group consisting of an effective microorganism colony and a derivative of an effective microorganism colony has or have been contained is or are arranged so as to permit contact with liquid fuel passing therethrough at an appropriate location in a fuel supply path.

Moreover, as recited in claim 7, another aspect of the invention is an internal combustion engine according to claim 5 or claim 6 wherein the aforesaid permanent magnet or magnets and the aforesaid ceramic body or bodies are contained within a mesh-like case disposed within a fuel tank.

In addition, as recited in claim 8, another aspect of the invention is an internal combustion engine according to claim 5 or claim 6 wherein the aforesaid permanent magnet or magnets and the aforesaid ceramic body or bodies are contained within an sealed case provided with one or more orifices for inlet and outlet of liquid fuel, said case being connected to a fuel path wherein it is inserted at an intermediate location.

In an aspect of the invention according to claim 1, because liquid fuel is made capable of coming in contact with a ceramic body or bodies derived from an effective microorganism colony and straddled by opposite magnetic poles, it is possible to conveniently obtain improved mileage, cleaner exhaust gases, and a cleaner liquid fuel system.

Furthermore, in an aspect of the invention according to claim 2, because a permanent magnet or magnets is or are arranged so as to be straddled by ceramic bodies derived from an effective microorganism colony, it is likewise easy to obtain improved mileage, cleaner exhaust gases, and a cleaner liquid fuel system.

Furthermore, in an aspect of the invention according to claim 3, because in addition to some or all of the features present in the aforesaid aspects of the invention according to claim 1 and claim 2 the ceramic body or bodies and the magnet or magnets have holes and are stacked one atop another, a liquid fuel reformer can easily be formed in compact fashion, producing a configuration having dimensions conforming to those which will permit the above-described effects to be produced to the maximum extent possible, and which, because of its integral construction, permits enjoyment of the additional benefit of ease of handling of the stacked assembly.

Moreover, in an aspect of the invention according to claim 4, because in addition to some or all of the features present in the aforesaid aspects of the invention according to claim 1 and claim 2 the ceramic body or bodies is or are spherical, large contact area with liquid fuel is ensured with good efficiency, and some or all of the effects described as resulting from the aspects of the invention according to claim 1 and claim 2 can be produced with good efficiency.

In addition, in an aspect of the invention according to claim 5, because a ceramic body or bodies derived from an effective microorganism colony is or are straddled by opposite magnetic poles and the liquid fuel reformer is inserted at an appropriate location in a fuel supply path, it is possible to provide effective reforming of fuel without the need to perform some operation or the other at every refueling.

Moreover, in an aspect of the invention according to claim 6, because a permanent magnet or magnets straddled by ceramic bodies derived from an effective microorganism colony is or are inserted at an appropriate location in a fuel supply path, it is possible to provide an internal combustion engine permitting simple production of a continuous fuel reforming effect.

Furthermore, in an aspect of the invention according to claim 7, because in addition to some or all of the features present in the aforesaid aspects of the invention according to claim 5 and claim 6 the ceramic body or bodies and the magnet or magnets are contained within a mesh-like case, in addition to some or all of the benefits of the aspects of the invention according to claim 5 and claim 6 it is also possible to enjoy the benefit of convenient reforming of a large volume of fuel.

Moreover, in an aspect of the invention according to claim 8, because in addition to some or all of the features present in the aforesaid aspects of the invention according to claim 5 and claim 6, the reformer is connected to a fuel path wherein it is inserted at an intermediate location, in addition to some or all of the benefits of the aspects of the invention according to claim 5 and claim 6 it is also possible to enjoy the benefit that the reformer can be easily applied to an internal combustion engine.

BRIEF DESCRIPTION OF DRAWINGS

These and other features, aspects, and advantages of the present invention will become better understood with reference to the following description, appended claims, and accompanying drawings where:

DESCRIPTION

The present invention pertains to a reformer capable of reforming liquid fuel so as to cause it to burn well, and to an internal combustion engine incorporating such a reformer.

Below, several exemplary embodiments of the invention are described with reference to the drawings.

First Embodiment

Figure 1:
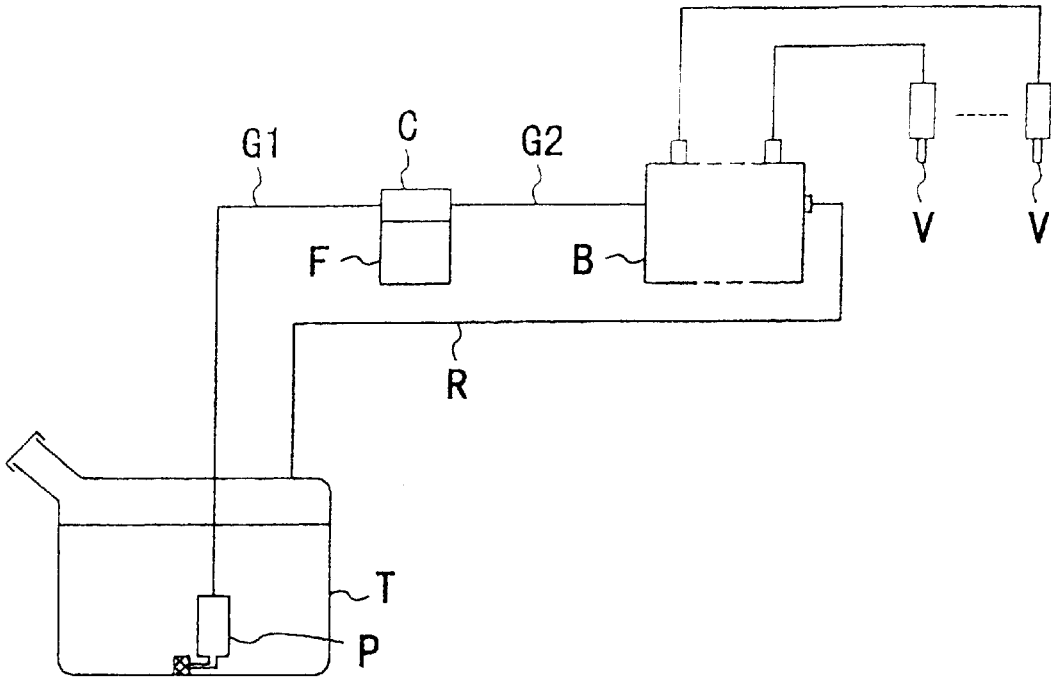
FIG. 1 is an explanatory diagram showing a liquid fuel system in an automobile.

Referring to FIG. 1, a fuel system for an automobile internal combustion engine associated with a first embodiment of the present invention is shown, fuel stored within a fuel tank T being delivered to an upstream supply pipe G1 by means of an in-tank pump P. The end of upstream supply pipe G1 is connected to a cover C at a peripheral location thereof and this cover C is threadedly engaged with a filter case F that houses a cartridge-type filter, the fuel which is delivered thereto being filtered as it passes through the filter in going from the exterior to the interior thereof. Furthermore, the filtered fuel passes through a downstream supply pipe G2 which is connected to the cover C at a central location thereof, and the far end of this downstream supply pipe G2 leads to a fuel injection pump B. This fuel injection pump B drives an internal combustion engine, and connected to this fuel injection pump B are fuel injection valves V, V, . . . , which direct fuel to be burnt for extraction of energy to the internal combustion engine and which correspond in number to file number of cylinders of that engine, and a return pipe R, which recirculates excess fuel not used for injection.

Figure 2:
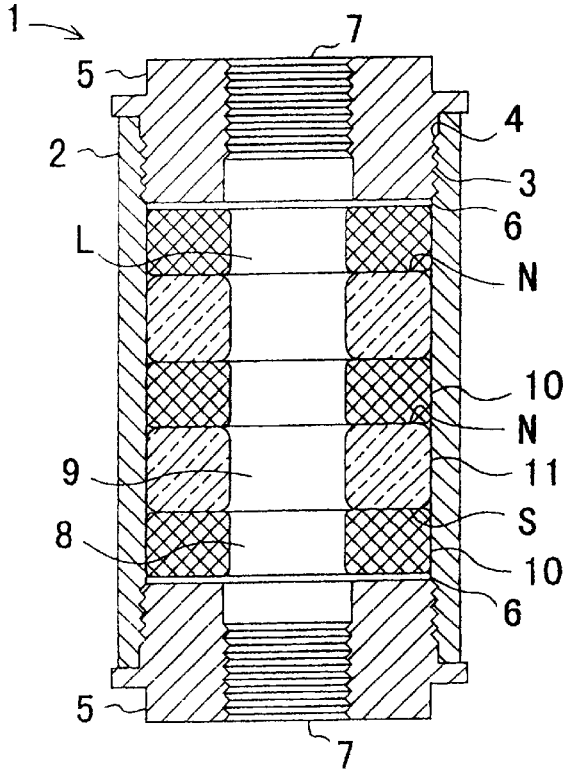
FIG. 2 is an explanatory diagram showing a central sectional view of a liquid fuel reformer associated with a first embodiment of the invention.

Referring now to FIG. 2, this is a central sectional view of a liquid fuel reformer 1 capable of being introduced into the foregoing system, preferably at a location in the fuel supply path from the fuel tank T to the several fuel injection valves V, V, . . . , inclusive. This liquid fuel reformer 1 is equipped with: an outer cylinder 2 made of transparent or translucent synthetic resin, female regions 3, 3 being respectively formed in threaded fashion at the interior of either open end thereof; couplings 5, 5 made of synthetic resin and having male regions 4, 4 capable of being connected to the respective female regions 3, 3; and screens 6, 6, which are respectively disposed so as to be adjacent and interior to the couplings 5, 5. The outer cylinder 2 and the couplings 5, 5 constitute a housing. Furthermore, the couplings 5, 5 are respectively provided with connection ports 7, 7 so as to allow flow of liquid fuel into and out therefrom by virtue of through-holes which pass therethrough more or less coaxially therewith, the inner surfaces of the material forming these through-holes being partially threaded.

Moreover, stacked in alternating fashion between screens 6, 6 such that their thicknesses are in the same direction as the direction of the aforementioned trough-hole axis are a plurality of permanent magnets 10, 10, . . . (three in the example shown in the drawing) and ceramic bodies 11, 11, . . . (two in the example shown in the drawing), these respectively being more or less flat and annular in shape and having more or less centrally located holes 8, 9, . . . of more or less mutually similar diameter. The permanent magnets 10, 10, . . . are arranged such that the north poles N, N, . . .

thereof all face in one direction, and the south poles S, S, . . . thereof all face in the opposite direction (the north poles N, N, . . . being directed downward in the example shown in the drawing), as a result of which each of the ceramic bodies 11, 11, . . . straddled thereby finds itself situated between opposing magnetic poles. This stacked assembly, which is held together in integral fashion by virtue of the magnetic attraction exerted by the permanent magnets 10, 10, . . . and which is moreover lightly held in place by the couplings 5, 5 by way of the intervening screens 6, 6, is equipped with a flow passage L formed by virtue of the fact that the holes 8, 9 . . . are mutually aligned one atop another so as to permit fluid communication along a common channel formed by those holes 8, 9, . . . and the connection ports 7, 7.

In addition, the ceramic bodies 11, 11 . . . are respectively formed by baking or firing a mixture wherein a substance (EM-Z) has been kneaded into and trapped within good-quality clay, this substance (EM-Z) being purifiable from a potable derivative (EM-X) which is in turn concentratable from low-molecular-weight fragments of polysaccharides or other antioxidant substances extractable from a coexisting effective microorganism colony liquid (EM) obtainable by culturing together at least an anaerobic variety or preferably one of each an aerobic and an anaerobic variety selected from among the following anabiotic microorganisms which are found in nature and which comprise members of various groups of effective fermentatious microorganisms and effective synthetic microorganisms, the term "effective" here referring to the fact such microorganisms are useful to people: lactobacillus and other lactic acid bacteria, photosynthetic bacteria, saccharomyces and other yeasts, aspergillus and other microorganisms present in malts (including Japanese koji-type malts), actinomyces and the like, azobacter and other nitrogen-fixing bacteria, and similar microorganism varieties. Accordingly, while living effective microorganisms have not themselves been found to be present within the respective ceramic bodies 11, 11, . . . the composition of those ceramic bodies 11, 11, . . . is nonetheless thought to differ from ordinary ceramic compositions and it is moreover plausible that the ceramic bodies 11, 11, . . . are causing clusters (molecular aggregates) within the liquid to be broken up into more basic units, this cluster-size-reducing effect being elicited by passage through lines of magnetic force; but, whatever the reason may be, it is in any event clear that the combination of magnets and EM ceramic bodies is effective in achieving cleaner burning and improved mileage, which effects are described further below. Furthermore, the respective permanent magnets 10, 10, . . . preferably produce magnetic forces on the order of 12,000 Gauss (10,000 to 14,000 Gauss) and are preferably arranged with a pitch on the order of 5 cm (3 to 20 cm) therebetween, the effectiveness of the ceramic bodies 11, 11, . . . , and their ability to sustain that effectiveness, peaking or at least permitting satisfactory operation under substantially these conditions.

The aforesaid liquid fuel reformer 1 may be incorporated in the internal combustion engine system by installing it in the fuel system, e.g., between the filter case F and the cover C thereof, by threading an adapter or adapters into one or both of the connection ports 7, 7 or by removing one or both of the couplings 5, 5 or removing one or both of the couplings 5, 5 and thereafter threading a different adapter or adapters into one or both of the female regions 3, 3 as may be required, and mating respective appropriately threaded members or portions of members of the neighboring upstream and downstream components (e.g., the filter case F and the cover C thereof) to such adaptor or adaptors, connection port or ports 7, 7, or female region or regions 3, 3, After passing through the fuel filter, liquid fuel enters the liquid fuel reformer 1 by way of the connection port 7 at one end of the liquid fuel reformer 1, passes through the screen 6 at that end thereof, passes through the internal holes 8, 9, . . . , coming in contact with the stacked assembly comprising the permanent magnets 10, 10, . . . and the ceramic bodies 11, 11, . . . , to arrive at the portion of the fuel system which is connected to the connection port 7 at the opposite end of that liquid fuel reformer 1 after passing through the screen 6 at that end thereof. Upon coming in contact with the ceramic bodies 11, 11, . . . , molecular clusters within the liquid fuel are made smaller or more uniform or an effect is produced such as that which might be expected had surface area been increased, improving combustive reactivity within the engine cylinders, rendering the fuel capable of more or less complete combustion with less dependence on combustion conditions, and permitting improved mileage as well as cleaner exhaust gases. Furthermore, with continued reference to FIG. 2 and with additional brief reference now to FIG. 1, passage of activated fuel, wherein cluster size is thought to be reduced, through the several pipes G2, R, and so forth permits freeing of deposits, contributing to cleaning of the fuel system each time that the automobile is used, provided that appropriate care is taken to maintain open passages and prevent clogging of pores by freed deposits in automobiles having high mileage. In addition, in a preferred embodiment, flow of liquid fuel in a direction causing it to pass from the north poles N, N, . . . to the south poles S, . . . of the permanent magnets 10, 10, . . . (from bottom to top at FIG. 2) results in alignment of the direction of the lines of magnetic force and the direction of flow, producing amplification of the above-described effect.

Furthermore, with continued reference to FIGS. 1 and 2, the liquid fuel reformer 1 may be incorporated within the fuel path by connecting it at a location where any of the several pipes G1, G2, or R is connected to the fuel pat or by connecting it at an intermediate location along any of the foregoing pipes G1, G2, or R or intermediate with respect to the fuel injection pump B or any of the fuel injection valves V, V, . . . . Here, incorporating the liquid fuel reformer 1 within the fuel path by, for example, threadedly mating appropriate members or portions of members with the connection ports 7, 7, and causing liquid fuel to flow through the stacked permanent magnets 10, 10, . . . and ceramic bodies 11, 11 . . . make it possible for an automobile to attain improved mileage and cleaner exhaust gases and the like. Am example of the very real extent to which exhaust gases can be made cleaner as a result of application of the invention can be understood from TABLE 1, which shows measurements of the density of soot present in exhaust gas exiting the muffler of a diesel engine automobile in which a liquid fuel reformer according to the present embodiment was incorporated at an intermediate location within the fuel supply path thereof (between the filter case F and the cover C of that filter case F). In collecting the data presented in TABLE 1, the automobile was driven in ordinary urban traffic for 10 minutes and was thereafter allowed to idle for 15 minutes, following which the accelerator was depressed for 3 seconds, at which time the measurements were made. Based on the data presented in TABLE 1, we can see that incorporation of the liquid fuel reformer of this first embodiment in a diesel engine caused soot density to be reduced by an average of 50%, and by a maximum of as much as 80%. In addition, improvement of mileage in this first embodiment was equivalent to that observed in the second embodiment, described below.

TABLE 1

Soot Density Reduction Due to Fuel Reformer

| | Soot Density (%) | |
|---|---|---|
| | Without Reformer | With Reformer |
| Trial 1 | 26 | 4 |
| Trial 2 | 18 | 8 |
| Trial 3 | 15 | 11 |
| Trial 4 | 14 | 14 |
| Trial 5 | 25 | 6 |
| Trial 6 | 18 | 12 |
| Trial 7 | 11 | 7 |
| Trial 8 | 14 | 8 |
| Trial 9 | 26 | 5 |
| Trial 10 | 10 | 12 |
| Average | 17.7 | 8.7 |

Furthermore, forming one or both of the connection ports 7, 7 so as to allow mating with one or more threaded members or portions of members already present at the automobile fuel system facilitates installation of the liquid fuel reformer 1 to the point where an ordinary individual is able to perform such installation without the need for special training or exotic tools, and once the liquid fuel reformer 1 is installed, the above-described reforming of liquid fuel takes place automatically and continuously thereafter with nothing more than ordinary refueling being required of the automobile operator, permitting enjoyment of improved mileage and cleaner exhaust gases and the like without further expenditure of effort on the part of the operator. However, while there is no dramatic decrease in the foregoing effect, some reduction in effectiveness may be observed depending on the location and orientation of the installed liquid fuel reformer 1 and the presence or absence of light thereat, some reduction in effect reportedly occurring, for example, after on the order of a half year when installed in a dark location, and because one remedy therefor involves exposing the ceramic bodies 11, 11, . . . to light for on the order of a half day to restore the effectiveness thereof, it is recommended that the hood of the automobile be opened or the liquid fuel reformer 1 be temporarily removed as necessary to allow exposure to light for an extended period every half year or so. Furthermore, in this regard, it has been found that without the lines of magnetic force from the permanent magnets 10, 10, . . . a the half-yew period during which effectiveness declines is further reduced to on the order of 1 month. While it may be more effective or preferred from the psychological perspective of the customer that the outer cylinder 2 possess translucency so as to ensure or give the appearance of ensuring that light does in fact reach the interior thereof, the outer cylinder 2 itself need not necessarily be translucent if such translucency is provided instead by a nearby part or parts; for example, it will be sufficient for the foregoing procedure if one or both of the couplings 5, 5 possesses or possess translucency. However, choice of material is not limited to synthetic resin, for example. Electromagnets may be employed as magnets. Attainment of equivalent effect has also been confirmed with ceramic bodies 11, 11, . . . manufactured by baking or firing of a substance wherein, instead of EM-Z, EM-X or EM itself or a substance related to or derived, for example by fermentation, therefrom (i.e., a substance derived in some way from an effective microorganism or microorganisms) has been kneaded, and accordingly the invention should be considered to include such variations. Furthermore, the ceramic bodies 11, 11, . . . need not be annular in shape, but may, for example, be prismatic or any other of a great many varieties of shapes, and the dimensions thereof may likewise be varied such that, for example, the dimension in the thickness direction is greater than the dimensions in all other directions, and moreover, the shapes, dimensions, locations, orientations, and so forth of the holes 8, 9, . . . and of the various other members and so forth may be freely altered to a great extent while yet attaining the effect of the invention. Moreover, variations are also possible with regard to the number and alternating arrangement of the permanent magnets 10, 10, . . . and the ceramic bodies 11, 11, . . . ; for example, a number of ceramic bodies 11, 11, . . . may be arranged continuously without a permanent magnet or magnets intervening therebetween so long as the ceramic body or bodies 11, 11, . . . is or are disposed between opposite poles of permanent magnets 10, 10. Furthermore, disposition of the liquid fuel reformer 1 in the liquid fuel flow path may be such that the liquid fuel passes through the liquid fuel reformer 1 before passing through the filter, and effect is attained even when flow is from the south poles S, S, . . . to the north poles N, N . . . . Moreover, it is also possible to arrange a plurality of liquid fuel reformers 1 in parallel ox in series as appropriate in order to achieve increased effectiveness, capacity, or the like.

Second Embodiment

Figure 3:
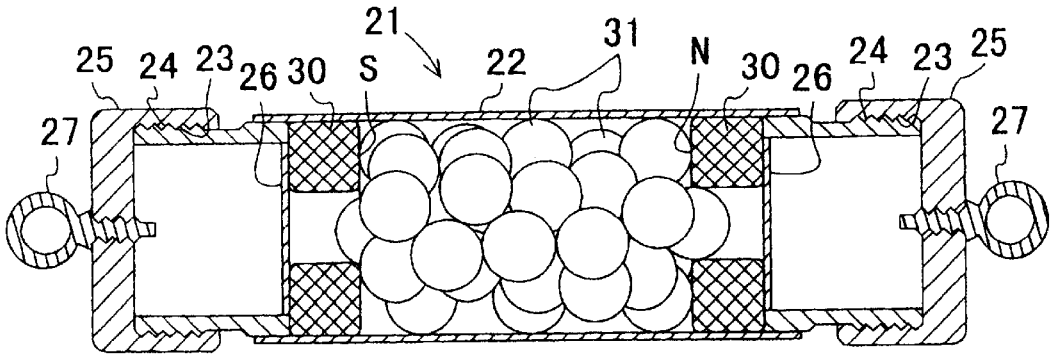
FIG. 3 is an explanatory diagram showing a partial central sectional view of a liquid fuel reformer associated with a second embodiment of the invention.

Referring now to FIG. 3, a liquid fuel reformer 21 associated with a second embodiment of the present invention is shown, this liquid fuel reformer 21 being provided with a case comprising a metal mesh cylinder 22 and couplings 25, 25, which are engaged by way of female threaded regions 24, 24 with male threaded regions 23, 23 located at either end of the mesh cylinder 22. Connecting fixtures 27, 27 are respectively attached to the couplings 25, 25, screens 26, 26 are respectively installed to the interior of imaginary planes drawn so as to be respectively perpendicular to the axis of the mesh cylinder 22 and so as to be respectively located between the mesh portion of the mesh cylinder 22 and the male threaded regions 23, 23 at either end thereof, and annular permanent magnets 30, 30 are arranged to the interior of the screens 26, 26 such that dissimilar poles face one another. Furthermore, the interior of the mesh cylinder 22 between the permanent magnets 30, 30 is packed with spherical ceramic bodies 31, 31, . . . which are made from a substance wherein effective microorganisms were contained.

Figure 4:
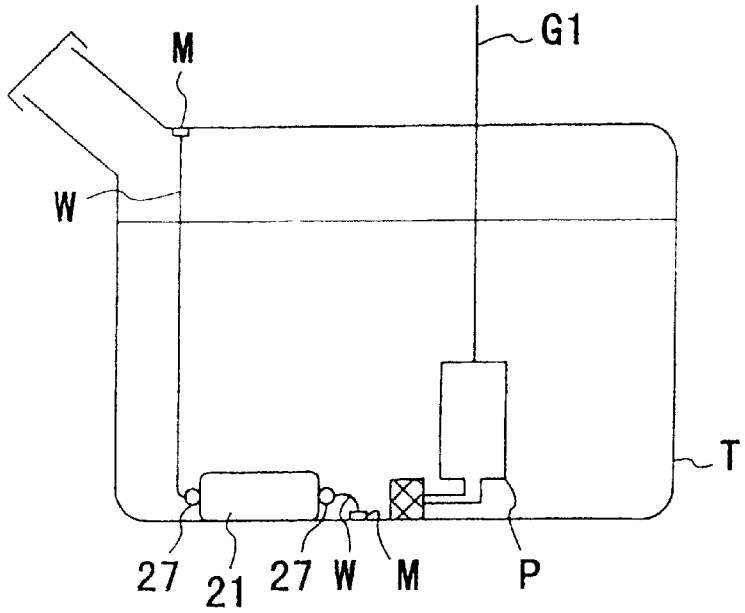
FIG. 4 is an explanatory diagram showing one manner of installing a liquid fuel reformer associated with a second embodiment of the invention.

The liquid fuel reformer 21 of the present embodiment is particularly suited to applications where the liquid fuel reformer 21 is to be built into a fuel tank T. In building it into same, this may be favorably carried out by securing the liquid fuel reformer 21 within the fuel tank T by, for example as shown in FIG. 4, fastening one end of a wire W onto one of the connecting fixtures 27, 27 and securing the other end of the wire W to the tank T by way of a permanent magnet M in such a manner as to avoid any interference with the fuel pump P or the like, and similarly using another wire W and another magnet M in similar fashion to fasten the other of the connecting fixtures 27, 27, but use of wires W and so fort may be unnecessary in the case of large fuel tanks T such as are present in large automobiles. Referring again briefly to FIG. 3, effectiveness of the multiplicity of spherical ceramic bodies 31, 31, . . . is elicited and maintained by activation due to magnetic forces even in the darkness existing within the fuel tank T, and the liquid fuel which passes through the mesh cylinder 22 is acted upon over a wide contact area, with cluster size reduction taking place for as long as on the order of a half year after installation. Because the reformer 21 is installed within the tank T wherein fuel is stored, a large effective volume of liquid filet is, on average, subjected to reforming over a relatively long period of time, with accompanying improvement in cleaning of filet pump P, supply pipes G1, G2, and the rest of the fuel system, as welt as improvement in mileage of the automobile. An example of the very real extent to which mileage can be improved as a result of application of the second embodiment—which here caused improvement by an average of 7%, and by a maximum of as much as 13%—can be understood from TABLE 2, which shows measurements of mileage (distance traveled per liter of fuel) of a diesel engine automobile in which a single liquid fuel reformer according to the second embodiment was installed within the fuel tank T thereof, and moreover, the extent to which exhaust gases were made cleaner in this second embodiment was more or less the same as that observed in the first embodiment, described above.

TABLE 2

Improvement in Mileage Due to Fuel Reformer

| | Mileage (km/liter) | |
|---|---|---|
| | Without Reformer | With Reformer |
| Trial 1 | 11.51 | 12.95 |
| Trial 2 | 12.53 | 13.02 |
| Trial 3 | 12.07 | 12.83 |
| Trial 4 | 12.01 | 12.89 |
| Trial 5 | 11.81 | 12.63 |
| Trial 6 | 11.64 | 12.58 |
| Average | 11.93 | 12.82 |

Figure 5:
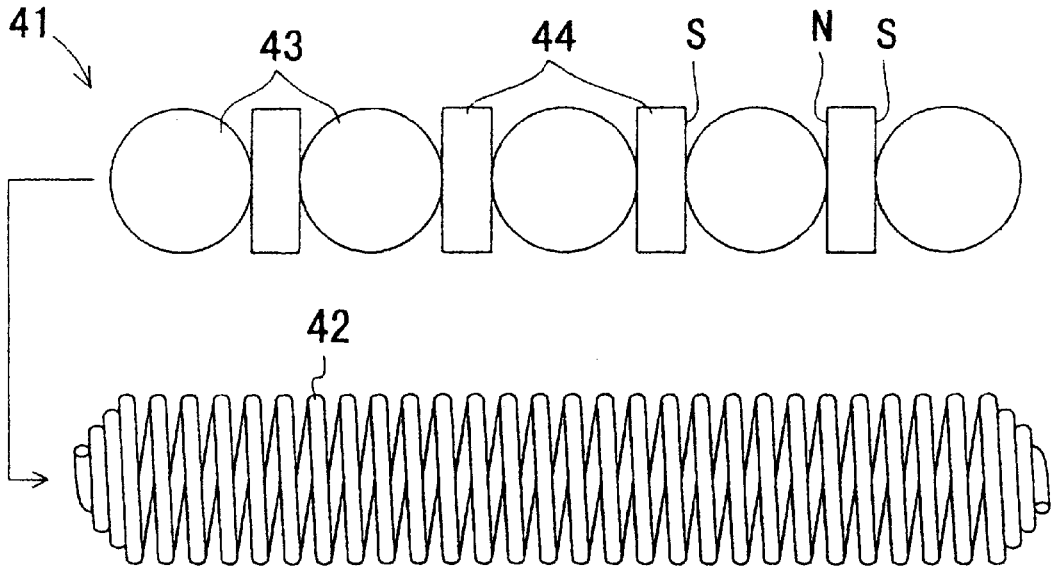
FIG. 5 is an explanatory diagram showing an exploded view of a liquid fuel reformer associated with a variation on an embodiment of the invention.

Furthermore, variations and so forth wit respect to component configuration, material, and the like may be carried out in much the same way as was the case with the first embodiment. For example, referring to FIG. 5, the case may take the form of a coil-spring-like member 42 made of stainless steel and wherein disk-like permanent magnets 44, 44, . . . are arranged between spherical ceramic bodies 43, 43, . . . such that the north poles N, N, . . . and the south poles S, S . . . thereof respectively face each other. The arrangement shown in FIG. 5 is effective in improving mileage and producing cleaner exhaust gases and the like to roughly the same extent as the first embodiment and the second embodiment, and is superior from the standpoints of cost and handling, being simply a strip of wound stainless steel constituting a case wherein the internal components (permanent magnets 44, 44, . . . and ceramic bodies 43, 43, . . . ) have been packed at some point during the winding thereof, moreover, installation can be carried out as simply as at the second embodiment, and furthermore, elongation and contraction of the coil-spring-like member 42 permit mobility for accommodation of pressure from the exterior or increase or decrease in size of internal components. Furthermore, while the ceramic bodies 43, 43 nearest either end of the coil-spring-like member 42 do not at first glance appear to be straddled by opposite magnetic poles, because lines of magnetic force do in fact pass therethrough as those lines of magnetic force loop back around to or from the other permanent magnets 44, 44, . . . , combustion-promoting action is maintained, and moreover, a great many variations may also be carried out here with respect to configuration, arrangement, material, and the like. For example, a plurality of liquid fuel reformers 21 may be introduced into a single tank, a container possessing one or more holes may be used in place of the mesh cylinder 22, the number of spherical ceramic bodies 31, 31, . . . may be increased or decreased, spherical ceramic bodies 31, 31, . . . may be mixed with flat or other such non-spherical ceramic bodies, or flat or other such non-spherical ceramic bodies may be used alone without using any spherical ceramic bodies 31, 31, . . . at all, and so forth. In addition, the present invention may be applied not only to automobile internal combustion engines but to other types of internal combustion engines as well, and the present invention may be used for reforming of kerosene and a wide variety of other liquid fuels, and the present invention may be incorporated in heaters, boilers, furnaces, stoves, and a great many other such devices which employ liquid fuel, where it may be used as a simple reforming apparatus available in a single, convenient package. Moreover, the case which houses the permanent magnets and EM ceramic body or bodies may constitute a part of the fuel line or other such component in the fuel system, and such part may be fashioned so as to permit easy replacement, or may be fashioned such that the EM ceramic body or bodies is or are as exposed as possible for simplification or parts reduction.

Figure 6:
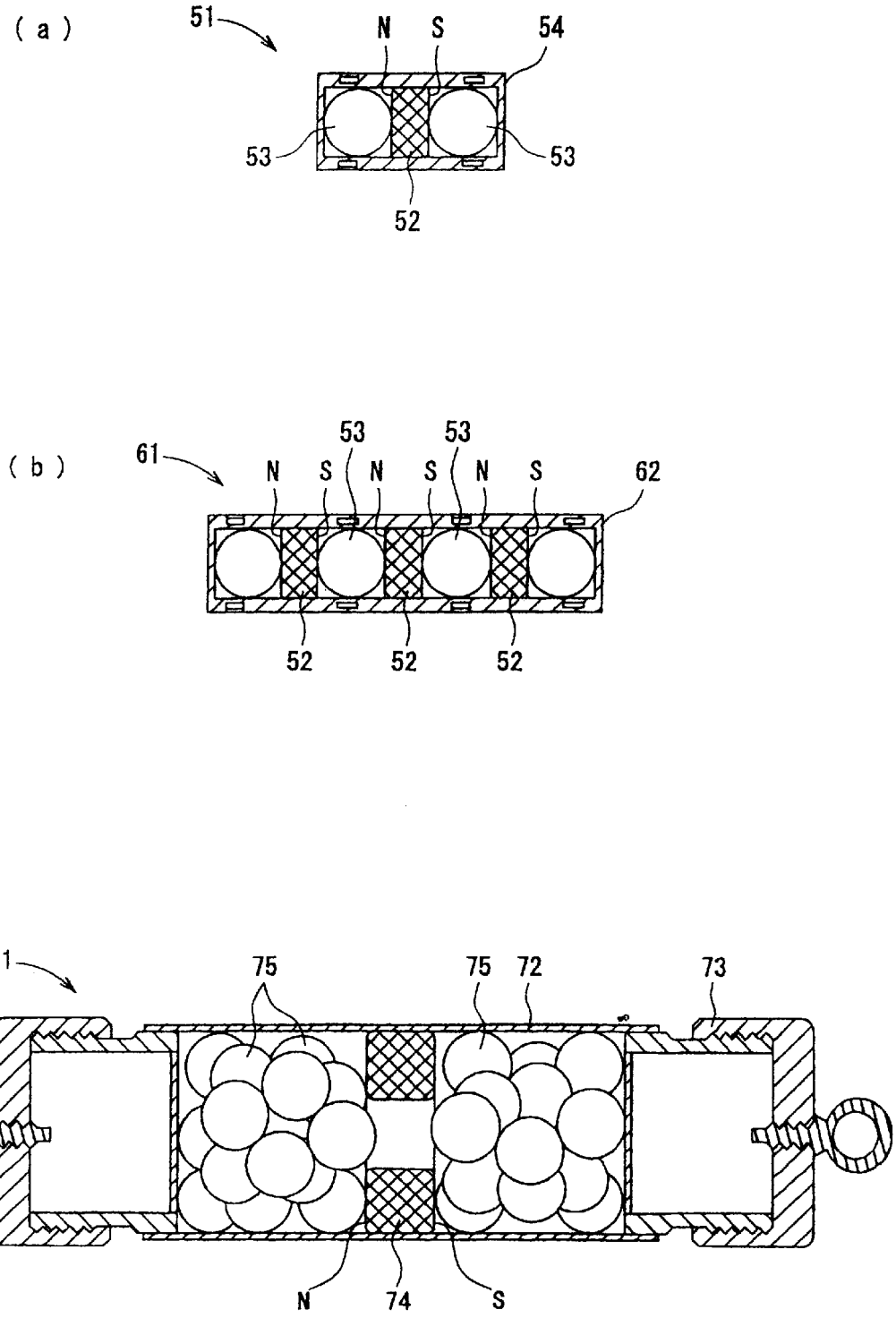
FIGS. 6(*a*) through (*c*) are explanatory diagrams respectively showing central sectional views of liquid fuel reformers associated with several different variations on embodiments of the invention.

Furthermore, because as described above, lines of magnetic force do pass through the ceramic bodies at either end of a series of such bodies, it is also possible to construct a liquid fuel reformer 51 as shown in FIG. 6(*a*). That is, a liquid fuel reformer 51 may be constructed wherein a plurality of spherical EM ceramic bodies 53, 53 formed by baking or firing of a substance wherein one or more items selected from among the group consisting of an effective microorganism colony and a derivative of an effective microorganism colony has or have been kneaded are arranged such that at least one of such bodies is present at each the north pole N side and the south pole S side of a single permanent magnet 52, the aforesaid components being enclosed within a cylindrical plastic mesh-like case 54 such that the permanent magnet 52 is straddled in some fashion by at least two of the EM ceramic bodies 53, 53. A liquid fuel reformer 51 constructed in this fashion will also permit sustained delivery of improved mileage and cleaning such as has been described above. Moreover, as shown in FIG. 6(*b*), through contiguous repetition of the permanent magnet 52—ceramic body 53 structure shown in FIG. 6(*a*) and enclosure of the repeated structure within a correspondingly longer case 62, it is possible to form a liquid fuel reformer 61 similar to the liquid fuel reformer shown in FIG. 5. In addition, as shown in FIG. 6(*c*), it is also possible to construct a liquid fuel reformer 71 such that a single permanent magnet 74 is arranged at what is roughly the center of a case 73 having a mesh portion 72 and wherein pluralities of ceramic bodies 75, 75, . . . are enclosed at either side of the permanent magnet 74. Here, the north pole N of the permanent magnet faces in the direction of the ceramic bodies 75, 75, . . . , or to be more precise, in such a direction as to cause lines of force emanating therefrom to be directed toward one of the clusters of ceramic bodies 75, 75, . . . , and in this case as well, lines of magnetic force will pass through each of the ceramic bodies 75, 75, . . . , permitting sustained reforming of fuel. Furthermore, any of these liquid fuel reformers 51, 61, 71 may be inserted at an appropriate location in a fuel supply path, Whereas several preferred embodiments of the present invention and variations thereof have been described above, these examples have been presented merely for purposes of describing the invention and it not intended that the invention should be limited thereto. The present invention may be carried out in the context of a wide variety of modes and embodiments other than those specifically presented herein.

What is claimed is:

1. A liquid fuel reformer comprising:

a) a case into and out from which liquid fuel can flow;

b) one or more ceramic bodies disposed within said case and formed by baking or firing of a substance wherein one or more items selected from among the group consisting of an effective microorganism colony and a derivative of an effective microorganism colony has or have been contained;

c) at least one pair of permanent magnets arranged such that there is a prescribed interval therebetween and such that opposite magnetic poles straddle the aforesaid ceramic body or bodies;

d) the aforesaid ceramic body or bodies and the aforesaid permanent magnet or magnets are substantially flat in shape;

e) one or more holes being formed in each of the aforesaid ceramic body or bodies and the aforesaid permanent magnet or magnets; and f) such ceramic body or bodies and permanent magnet or magnets being stacked one atop another such that the holes thereof overlap in the thickness direction so as to form a channel or channels for passage of liquid at the interior thereof.

2. A liquid fuel reformer comprising:

a) a case into and out from which liquid fuel can flow;

b) one or more permanent magnets arranged such that the north pole or poles thereof face in a prescribed direction;

c) at least two ceramic bodies formed by baking or firing of a substance wherein one or more items selected from among the group consisting of an effective microorganism colony and a derivative of an effective microorganism colony has or have been contained;

d) the aforesaid permanent magnet or magnets being disposed within said case such that all or any subset of said magnet or magnets are or is straddled in some fashion by at least two of the aforesaid ceramic bodies;

e) the aforesaid ceramic body or bodies and the aforesaid permanent magnet or magnets are substantially flat in shape;

f) one or more holes being formed in each of the aforesaid ceramic body or bodies and the aforesaid permanent magnet or magnets; and g) such ceramic body or bodies and permanent magnet or magnets being stacked one atop another such that the holes thereof overlap in the thickness direction so as to form a channel or channels for passage of liquid at the interior thereof.

* * * * *